US010368153B2

(12) United States Patent
Abe et al.

(10) Patent No.: US 10,368,153 B2
(45) Date of Patent: Jul. 30, 2019

(54) WATERPROOF SOUND-TRANSMITTING MEMBRANE AND WATERPROOF SOUND-TRANSMITTING STRUCTURE USING THE SAME

(71) Applicant: NITTO DENKO CORPORATION, Ibaraki-shi, Osaka (JP)

(72) Inventors: Yuichi Abe, Osaka (JP); Kouji Furuuchi, Osaka (JP); Kousei Takiishi, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 0 days.

(21) Appl. No.: 15/037,245

(22) PCT Filed: Nov. 14, 2014

(86) PCT No.: PCT/JP2014/005740
§ 371 (c)(1),
(2) Date: May 17, 2016

(87) PCT Pub. No.: WO2015/072149
PCT Pub. Date: May 21, 2015

(65) Prior Publication Data

US 2016/0301998 A1 Oct. 13, 2016

(30) Foreign Application Priority Data

Nov. 18, 2013 (JP) ..... 2013-237867

(51) Int. Cl.
*H04R 1/08* (2006.01)

(52) U.S. Cl.
CPC ..... *H04R 1/086* (2013.01); *H04R 2499/11* (2013.01)

(58) Field of Classification Search
CPC ..... H04R 1/086
See application file for complete search history.

(56) References Cited

U.S. PATENT DOCUMENTS 3,544,733 A * 12/1970 Reylek ..... H04R 19/00 29/594
5,828,012 A * 10/1998 Repolle ..... H04R 1/023 181/175

(Continued)

FOREIGN PATENT DOCUMENTS

JP 3-041182 2/1991
JP 2008-245332 10/2008

(Continued)

OTHER PUBLICATIONS

Observations by a Third Party issued for corresponding European Patent Application No. 14861875.4, dated Mar. 23, 2017, 15 pages.

(Continued)

*Primary Examiner* — Duc Nguyen
*Assistant Examiner* — Taunya McCarty
(74) *Attorney, Agent, or Firm* — Hamre, Schumann, Mueller & Larson, P.C.

(57) ABSTRACT

A waterproof sound-transmitting membrane (10) includes a sound-transmitting region (13*c*) having a porous polytetrafluoroethylene (PTFE) membrane (11). The porous PTFE membrane (11) has a through-thickness air permeability of 2 $cm^3/cm^2/s$ or more. Thus, it is possible to provide a waterproof sound-transmitting membrane that is suitable for reducing crackling noise while ensuring waterproofness required for at least daily use. The porous PTFE membrane (11) has a water entry pressure of 3 kPa or more, preferably 20 kPa or more and 50 kPa or less. The waterproof sound-transmitting membrane (10) may include an edge region (13*p*) having an adhesive layer (12).

4 Claims, 3 Drawing Sheets

(56) References Cited

U.S. PATENT DOCUMENTS

| | | | | |
|---|---|---|---|---|
| 6,512,834 | B1 | 1/2003 | Banter et al. | |
| 2008/0104738 | A1* | 5/2008 | Conley | A41D 31/02 2/82 |
| 2009/0267252 | A1 | 10/2009 | Ikeyama | |
| 2009/0277141 | A1* | 11/2009 | Abe | B01D 67/0027 55/528 |
| 2010/0206660 | A1* | 8/2010 | Horie | B29C 47/0021 181/175 |
| 2010/0242733 | A1 | 9/2010 | Shimatani | |
| 2010/0247857 | A1* | 9/2010 | Sanami | H04M 1/18 428/138 |
| 2015/0050464 | A1 | 2/2015 | Ishii et al. | |

FOREIGN PATENT DOCUMENTS

| | | | |
|---|---|---|---|
| JP | 2011-142680 | | 7/2011 |
| KR | 20080086487 | | 9/2008 |
| KR | 20100103557 | | 9/2010 |
| WO | 0103468 | A2 | 1/2001 |
| WO | 2013168203 | A1 | 11/2013 |

OTHER PUBLICATIONS

Extended European Search Report issued for corresponding European Patent Application No. 14861875.4, dated May 30, 2017, 8 pages.

* cited by examiner

WATERPROOF SOUND-TRANSMITTING MEMBRANE AND WATERPROOF SOUND-TRANSMITTING STRUCTURE USING THE SAME

TECHNICAL FIELD

The present invention relates to a waterproof sound-transmitting membrane and a waterproof sound-transmitting structure including the membrane.

BACKGROUND ART

In electronic devices such as mobile phones, smartphones, and digital video cameras, audio components are mounted in their housings. Such a housing has an opening for allowing sound to pass through. In order to prevent water from entering the housing through the opening, the opening is covered with a waterproof sound-transmitting membrane that allows sound to pass through but prevents water from passing through. As such waterproof sound-transmitting membranes, porous polytetrafluoroethylene (PTFE) membranes are usually used.

Patent Literature 1 discloses a waterproof sound-transmitting membrane having both a low acoustic transmission loss and a high water entry pressure. According to Patent Literature 1, important parameters on which to focus are the mass and thickness of the waterproof sound-transmitting membrane, not the air permeability of the membrane (i.e., air flow passing through the membrane). A reduction in both the mass and thickness of the waterproof sound-transmitting membrane leads to an increase in the acoustic energy transmitted by vibration of the membrane. Therefore, the acoustic transmission loss does not increase even if the air permeability is reduced to achieve a high water entry pressure. Patent Literature 1 discloses a waterproof sound-transmitting membrane having a thickness of 3 to 33 μm, a mass of 40 g/m$^2$ or less, and an air permeability of 1 second or more in terms of Gurley number (i.e., about 1.57 cm$^3$/cm$^2$/s or less in terms of Frazier number).

CITATION LIST

Patent Literature

Patent Literature 1: JP 2011-142680 A

SUMMARY OF INVENTION

Technical Problem

Conventionally, acoustic transmission loss is used as a measure of the sound transmission characteristics of waterproof sound-transmitting membranes to be evaluated. However, the quality of sound to be transmitted, specifically, the level of so-called "crackling noise" is also an important measure of the characteristics in practical use. On the other hand, the level of waterproofness required by waterproof sound-transmitting membranes varies according to the type and use of electronic devices to be provided with the membranes. An electronic device, for example, which is not designed for use underwater but designed for exposure to water such as rainwater, does not need to be provided with a waterproof sound-transmitting membrane having a water entry pressure as high as 100 kPa or more but needs to be provided with a waterproof sound-transmitting membrane having a water entry pressure high enough to ensure waterproofness required for daily use.

It is an object of the present invention to provide a waterproof sound-transmitting membrane that is suitable for reducing crackling noise while ensuring waterproofness required for at least daily use.

Solution to Problem

The present inventors' studies indicate that the air permeability of a waterproof sound-transmitting membrane needs to be adjusted in order to reduce crackling noise.

The present invention provides a waterproof sound-transmitting membrane including a sound-transmitting region having a porous membrane of PTFE. This porous membrane has a through-thickness air permeability of 2 cm$^3$/cm$^2$/s or more as measured by Method A (Frazier method) for air permeability measurement according to JIS L 1096 and a water entry pressure of 3 kPa or more as measured by Method B (high hydraulic pressure method) for waterproofness testing according to JIS L 1092.

The present invention also provides a waterproof sound-transmitting structure including; a housing having an opening; and the waterproof sound-transmitting membrane of the present invention attached to the housing so as to cover the opening.

Advantageous Effects of Invention

According to the present invention, it is possible to provide a waterproof sound-transmitting membrane that is suitable for reducing crackling noise while ensuring waterproofness required for at least daily use because the waterproof sound-transmitting membrane includes a porous PTFE membrane having a water entry pressure of 3 kPa or more and an air permeability of 2 cm$^3$/cm$^2$/s or more in terms of Frazier number (i.e., about 0.79 seconds or less in terms of Gurley number).

DESCRIPTION OF EMBODIMENTS

Hereinafter, embodiments of the present invention will be described with reference to the accompanying drawings.

Figure 1:
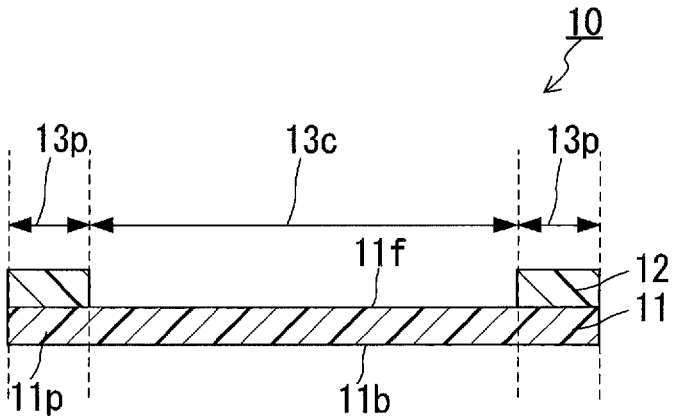
FIG. 1 is a cross-sectional view schematically showing an example of a waterproof sound-transmitting membrane of the present invention.
Figure 2:
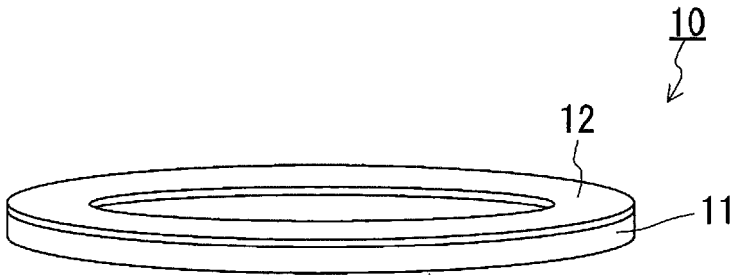
FIG. 2 is a perspective view schematically showing an example of a waterproof sound-transmitting membrane of the present invention.

FIG. 1 is a cross-sectional view of a waterproof sound-transmitting membrane 10 of the present embodiment, and FIG. 2 is a perspective view of the waterproof sound-transmitting membrane 10. The waterproof sound-transmitting membrane 10 has a sound-transmitting region 13*c* allowing sound to pass through and an edge region 13*p* surrounding the sound-transmitting region 13*c*. The sound-transmitting region 13*c* consists of a single layer of a porous PTFE membrane 11. The edge region 13*p* is composed of the porous PTFE membrane 11 and an adhesive layer 12. The adhesive layer 12 may be made of an adhesive material itself but may be a double-sided adhesive tape.

The porous PTFE membrane 11 has a through-thickness air permeability of 2 $cm^3/cm^2/s$ or more in terms of a value as measured by Method A (Frazier method) for air permeability measurement according to JIS L 1096. The through-thickness air permeability of the porous PTFE membrane 11 is preferably 3 $cm^3/cm^2/s$ or more, and more preferably 5 $cm^3/cm^2/s$ or more. In the waterproof sound-transmitting membrane 10 of the present embodiment, the air permeability of the porous PTFE membrane 11 is adjusted within the above-mentioned range, and thus crackling noise is reduced. The through-thickness air permeability of the porous PTFE membrane 11 is preferably 25 $cm^3/cm^2/s$ or less, and more preferably 6 $cm^3/cm^2/s$ or less.

The porous PTFE membrane 11 has a water entry pressure of 3 kPa or more in terms of a value as measured by Method B (high hydraulic pressure method) for waterproofness testing according to JIS L 1092. Since the water entry pressure of the porous PTFE membrane 11 is 3 kPa or more, the membrane 11 ensures waterproofness of at least class 4 in terms of the degree of protection against water entry according to JIS C 0920 (corresponding to IPX-4 level waterproofness required for daily use). The water entry pressure of the porous PTFE membrane 11 is preferably 15 kPa or more and 75 kPa or less, and more preferably 20 kPa or more and 50 kPa or less.

In order to further enhance waterproofness while sufficiently reducing crackling noise, it is particularly preferable that the porous PTFE membrane 11 have an air permeability of 5 $cm^3/cm^2/s$ or more and a water entry pressure of 20 kPa or more and 50 kPa or less.

The mass of the porous PTFE membrane 11 is, for example, 4 $g/m^2$ or less. The mass of the porous PTFE membrane 11 is preferably 2 $g/m^2$ or less, and more preferably 1.5 $g/m^2$ or less. The thickness of the porous PTFE membrane 11 is, for example, 17 μm or less. The thickness of the porous PTFE membrane 11 is preferably 15 μm or less, and more preferably 11 μm or less.

The waterproof sound-transmitting membrane 10 of the present embodiment includes a double-sided adhesive tape serving as the adhesive layer 12 for bonding the porous PTFE membrane 11 to an adherend such as a housing. The double-sided adhesive tape is attached to a portion of the front surface 11*f* of the porous PTFE membrane 11 corresponding to an edge portion 11*p* of the membrane 11. The adhesive layer 12 such as a double-sided adhesive tape is disposed on the front surface 11*f* of the porous PTFE membrane 11 to surround the sound-transmitting region 13*c*. The adhesive layer 12 may be formed on the back surface 11*b*, or the adhesive layers 12 may be formed on both the front surface 11*f* and the back surface 11*b*.

The porous PTFE membrane 11 may be subjected to water repellent treatment or oil repellent treatment. Water repellent treatment or oil repellent treatment can be performed by impregnating the porous PTFE membrane 11 with a material having a lower surface tension than PTFE from the front surface 11*f* and/or the back surface 11*b*.

The porous PTFE membrane 11 may contain a colorant such as a pigment or a dye. Examples of the dye include azo dyes and oil-soluble dyes. A preferable example of the colorant is carbon black.

Figure 3:
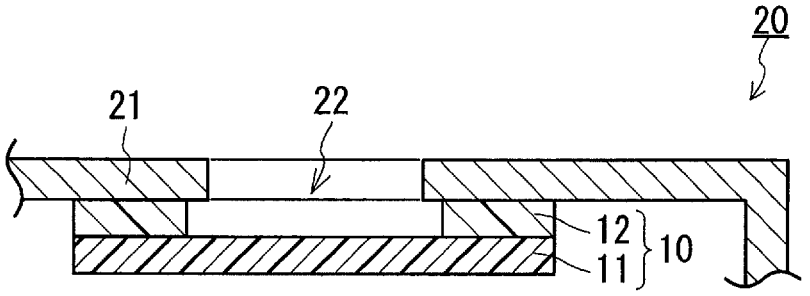
FIG. 3 is an enlarged cross-sectional view schematically showing an example of a waterproof sound-transmitting structure of the present invention.

FIG. 3 shows a waterproof sound-transmitting structure 20 including the waterproof sound-transmitting membrane 10 disposed therein. The waterproof sound-transmitting structure 20 includes a housing 21 having an opening 22 and the waterproof sound-transmitting membrane 10 attached to the housing 21 so as to cover the opening 22. The waterproof sound-transmitting membrane 10 is fixed to the housing 21 by means of the adhesiveness of the adhesive layer 12. The porous PTFE membrane 11 may also be fixed directly to the housing 21 by ultrasonic bonding or the like without the adhesive layer 12. In this case, the edge region 13*p* of the waterproof sound-transmitting membrane 10 also consists of a single layer of the porous PTFE membrane 11.

Figure 4:
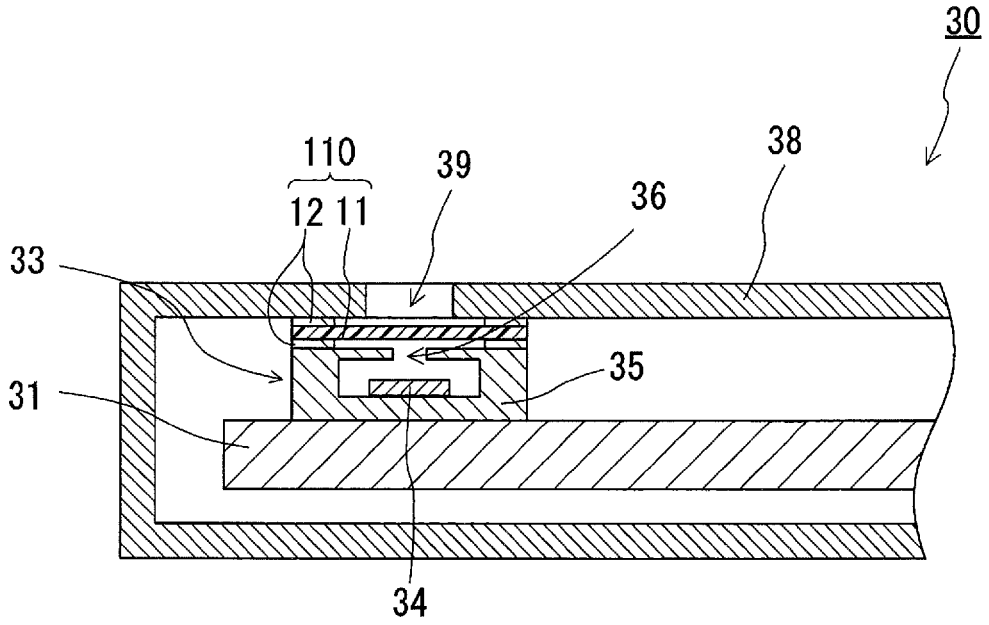
FIG. 4 is an enlarged cross-sectional view schematically showing an example of an electronic device including a waterproof sound-transmitting membrane of the present invention.

FIG. 4 shows a mobile phone 30 as an example of an electronic device provided with a waterproof sound-transmitting membrane 110 including the porous PTFE membrane 11. The waterproof sound-transmitting membrane 110 in the mobile phone 30 is the same as the waterproof sound-transmitting membrane 10 except that the membrane 110 includes another double-sided adhesive tape as the adhesive layer 12 that is attached to the back surface 11*b* of the porous PTFE membrane 11.

A housing 38 of the mobile phone 30 contains a microphone 33. The housing 38 has a first sound collecting hole 39 for introducing external sound to the microphone 33. A sound collecting portion 34 for converting sound into electric signals is disposed in a package 35 of the microphone 33. The package 35 has, in one side thereof, a second sound collecting hole 36 for introducing the sound having been introduced into the housing 38 through the first sound collecting hole 39 thereof to the sound collecting portion 34 of the microphone 33. The first sound collecting hole 39 and the second sound collecting hole 36 are separated from each other by the waterproof sound-transmitting membrane 110. The microphone 33 is connected electrically to a circuit board 31 of the mobile phone 30 by a terminal (not shown) provided on the bottom of the package 35. The electric signals converted from sound by the sound collecting portion 34 are outputted to the circuit board 31 via the terminal. In the mobile phone 30, the waterproof sound-transmitting membrane 110, which is disposed so as to cover the first sound collecting hole 39 and the second sound collecting hole 36, allows sound to be transmitted to the sound collecting portion 34 of the microphone 33 while preventing foreign matters such as dust and water from entering the sound collecting portion 34 through the first sound collecting hole 39 and the second sound collecting hole 36.

Next, an example of a production method suitable for producing a waterproof sound-transmitting membrane having a sound transmitting region consisting of a single layer of a porous PTFE membrane as described above is described.

First, a mixture containing a PTFE fine powder and a forming aid (liquid lubricant) at a predetermined ratio is kneaded well to prepare a paste for use in extrusion molding. Next, the paste is preformed and then formed into a sheet or a rod by a well-known extrusion process to obtain a molded sheet or rod. Next, the molded sheet or rod is rolled to obtain a strip of PTFE sheet. Next, the rolled PTFE sheet is dried in a drying oven. The forming aid is evaporated during the drying process, and therefore, the content of the forming aid in the resulting PTFE sheet is sufficiently reduced. Next, the PTFE sheet thus dried is stretched in the longitudinal direction (MD) and in the transverse direction (TD) perpendicular to the longitudinal direction. The PTFE sheet thus stretched in two directions may be sintered at a temperature equal to or higher than the melting point of PTFE.

In order to produce a waterproof sound-transmitting membrane causing less sound distortion, it is preferable to stretch the PTFE sheet at a temperature equal to or lower than the melting point of PTFE (for example, 327° C.) and then perform heat setting to the PTFE sheet at a temperature equal to or higher than the melting point of PTFE. The temperature for stretching the PTFE sheet is, for example, 50° C. to 320° C., and preferably 100° C. to 300° C. The temperature of heat setting to the PTFE sheet is, for example 330° C. to 400° C., and preferably 350° C. to 380° C.

EXAMPLES

Example 1

100 parts by weight of a PTFE fine powder (F-104 manufactured by Daikin Industries, Ltd.) and 20 parts by weight of a liquid lubricant (n-dodecane manufactured by Japan Energy Corporation) were homogeneously mixed. The obtained mixture was compressed in a cylinder and then formed into a sheet by ram extrusion. The resulting sheet containing the liquid lubricant is passed between metal rolls and thus the sheet was rolled to a thickness of 0.2 mm. The rolled sheet was dried by heating at 150° C. to remove the liquid lubricant. Thus, an unsintered molded sheet was obtained. This molded sheet was stretched in the longitudinal direction by a factor of 10 at 300° C., and then stretched in the transverse direction by a factor of 30 at 100° C. Then, the molded sheet was allowed to stand still at 360° C., which was higher than the melting point of PTFE, so as to perform heat setting to the sheet. Thus, a porous PTFE membrane of Example 1 was obtained.

Example 2

A porous PTFE membrane of Example 2 was obtained in the same manner as in Example 1, except that the molded sheet was stretched in the longitudinal direction by a factor of 20 and stretched in the transverse direction by a factor of 40.

Example 3

A porous PTFE membrane of Example 3 was obtained in the same manner as in Example 1, except that the molded sheet was stretched in the longitudinal direction by a factor of 25 and stretched in the transverse direction by a factor of 40.

Example 4

A porous PTFE membrane of Example 4 was obtained in the same manner as in Example 1, except that the molded sheet was stretched in the longitudinal direction by a factor of 30 and stretched in the transverse direction by a factor of 40.

Comparative Example 1

A porous PTFE membrane of Comparative Example 1 was obtained in the same manner as in Example 1, except that the molded sheet was stretched in the longitudinal direction by a factor of 3 and stretched in the transverse direction by a factor of 40.

Comparative Example 2

A porous PTFE membrane of Comparative Example 2 was obtained in the same manner as in Example 1, except that the molded sheet was stretched in the longitudinal direction by a factor of 5 and stretched in the transverse direction by a factor of 50.

Comparative Example 3

A porous PTFE membrane of Comparative Example 3 was obtained in the same manner as in Example 1, except that the molded sheet was stretched in the longitudinal direction by a factor of 8 and stretched in the transverse direction by a factor of 10.

Comparative Example 4

A nonporous polyethylene terephthalate (PET) film (Lumirror (registered trademark) F53, manufactured by Toray Industries, Inc.) was prepared.

The porous PTFE membranes of Examples 1 to 4 and Comparative Examples 1 to 3 and the PET film of Comparative Example 4 were evaluated for their thickness, weight, air permeability, water entry pressure, sound distortion, sound transmission loss, and the level of crackling noise.

[Thickness]

The thickness of each of the porous PTFE membranes and the PET film was measured by a dial gauge with a scale interval of 0.001 mm and equipped with a probe having an outer diameter of 10 mm.

[Weight]

The weight of each of the porous PTFE membranes and the PET film was obtained as follows. Each of the porous PTFE membranes and the PET film was cut into a 10-cm square piece, the weight of the piece was measured, and then the weight per unit area was obtained.

[Air Permeability]

The air permeability of each of the porous PTFE membranes and the PET film in terms of Frazier number (i.e., a volume of air passing through each of the porous PTFE membranes and the PET film per unit area and unit time under a predetermined pressure) was obtained by Method A (Frazier method) according to JIS L 1096.

[Water Entry Pressure]

The water entry pressure of each of the porous PTFE membranes was measured by Method B (high hydraulic pressure method) for waterproofness testing according to JIS L 1092 using a water resistance tester (for high hydraulic pressure). However, if the membrane having an area specified in JIS L 1092 is used for measurement, the membrane is significantly deformed. Therefore, in order to reduce the deformation, a stainless steel mesh (with an opening diameter of 2 mm) was provided on one side of the membrane opposite to the side to which pressure was to be applied, and in this state, the measurement was performed.

[Sound Distortion]

Sound distortion in each sample was evaluated in the following manner.

Figure 5:
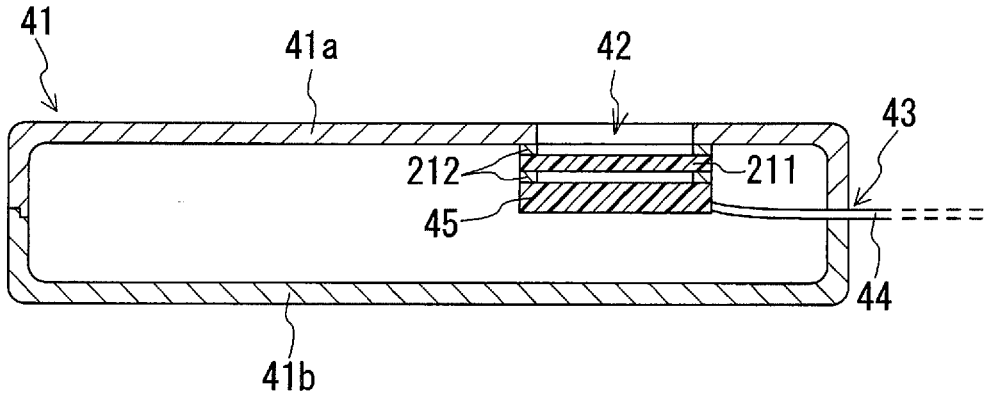
FIG. 5 is a schematic diagram illustrating a method for evaluating waterproof sound-transmitting membranes used in Examples.

First, as shown in FIG. 5, a simulated housing 41 (acrylic housing of 70 mm long, 50 mm wide, and 15 mm high) intended to be used as a housing of a mobile phone was prepared. This simulated housing 41 was composed of a first portion 41*a* and a second portion 41*b*, and the first and second portions 41*a* and 41*b* were adapted to be fitted together. The first portion 41*a* was provided with a mounting hole 42 (with a diameter of 13 mm). The simulated housing 41 was configured to form a space with no other opening than the mounting hole 42 and a guide hole 43 for a lead wire 44 therein when the first portion 41*a* and the second portion 41*b* were fitted together.

Separately from the preparation of the housing, each of the porous PTFE membranes and the PET film prepared in Examples and Comparative Examples (in FIG. 5, a porous PTFE membrane is designated with a reference numeral 211) was cut into a disk shape with a diameter of 16 mm using a Thompson die cutter. Next, ring-shaped double-sided adhesive tapes 212 with an outer diameter of 16 mm and an inner diameter of 13 mm were attached to the edge portions of both principal surfaces of the disk-shaped porous PTFE membrane thus obtained. Then, the porous PTFE membrane was attached, with one of the double-sided adhesive tape 212, to a speaker 45 (SCC-16A with a diameter of 16 mm, manufactured by Star Micronics Co., Ltd.) serving as a sound source.

Next, the speaker 45 with the porous PTFE membrane attached thereto was fixed to the inner side of the first portion 41*a*, which served as a part of the inner surface of the housing 41 when the first portion 41*a* and the second portion 41*b* were fitted together, toward the mounting hole 42 in the first portion 41*a* of the simulated housing 41 so that the porous PTFE membrane faced the mounting hole 42 and covered the hole 42 from inside. One of the double-sided adhesive tapes 212 provided on the opposite side of the porous PTFE membrane from the speaker 45 was used to fix the speaker 45 to the first portion 41*a*. The speaker 45 was fixed to the first portion 41*a* carefully to avoid overlapping of the mounting hole 42 and the double-sided adhesive tape 212 but to completely cover the mounting hole 42 with the porous PTFE membrane.

Next, the first portion 41*a* and the second portion 41*b* were fitted together while the lead wire 44 of the speaker 45 was led to the outside of the simulated housing 41 through the guide hole 43. Thus, the simulated housing 41 for measuring the sound transmission loss of the porous PTFE membrane was formed. After the lead wire 44 was led to the outside through the guide hole 43, the guide hole 43 was sealed with putty.

Next, the lead wire 44 and a microphone (a combination of Type 2669 and Type 4192 manufactured by B&K Corporation) were connected to an acoustic evaluation apparatus (3560-B-030 manufactured by B&K Corporation), and the microphone was placed 50 mm away from the speaker 45.

The porous PTFE membrane was mounted in the manner as described above, and then total harmonic distortion (THD) was evaluated as sound distortion. The total harmonic distortion was obtained as a ratio (%) of the sum of the measured values of all harmonic components to the measured value of the fundamental frequency. The measured values of all harmonic components were obtained by measuring the second- and third-order harmonic components.

[Sound Transmission Loss]

Sound transmission loss in each sample was evaluated in the following manner using the same evaluation apparatus as the apparatus used for the evaluation of the sound distortion described above.

The sound pressure level received by a microphone when the porous PTFE membrane was mounted in the manner as described above and the sound pressure level received by the microphone under the same conditions except for the absence of the porous PTFE membrane were measured, and the difference between the measured levels was used to evaluate the sound transmission loss (dB). Sound at a frequency of 1000 Hz was used for the measurement. The sound transmission loss of 5 dB or less means high sound transmissibility.

[Crackling Noise]

The level of crackling noise in each sample was evaluated in the following manner using the same evaluation apparatus as the apparatus used for the evaluation of the sound distortion described above.

The porous PTFE membrane was mounted in the manner as described above, and whether subjects heard crackling noise or not was evaluated. When the subjects heard no crackling noise, the sample was rated as having "no crackling noise" (good). When the subjects heard a faint crackling noise, the sample was rated as having a "faint crackling noise" (fair). When the subjects heard a crackling noise, the sample was rated as having a "crackling noise" (poor).

Table 1 shows the results of the above-described evaluation of the porous PTFE membranes and the PET film for their thickness, weight, air permeability, water entry pressure, sound distortion, sound transmission loss, and the level of crackling noise.

TABLE 1

| | | | | | Acoustic characteristics | | |
|---|---|---|---|---|---|---|---|
| | Thickness (μm) | Weight ($g/m^2$) | Air permeability ($cm^3/cm^2/s$) | Water entry pressure (kPa) | Sound distortion (%) | Sound transmission loss (dB) | Crackling noise sensory test |
| Ex. 1 | 10 | 4.0 | 2.0 | 50 | 60.2 | 0.66 | Good |
| Ex. 2 | 6 | 1.3 | 5.1 | 20 | 52.7 | 0.69 | Good |
| Ex. 3 | 11 | 0.5 | 11.2 | 8 | 44.9 | 0.83 | Good |
| Ex. 4 | 8 | 0.4 | 21.4 | 5 | 22.3 | 0.52 | Good |
| Com. Ex. 1 | 12 | 6.7 | 0.1 | 200 | 90.0 | 1.37 | Poor |
| Com. Ex. 2 | 10 | 3.9 | 0.4 | 160 | 87.1 | 0.52 | Poor |
| Com. Ex. 3 | 20 | 10.0 | 1.5 | 80 | 73.4 | 1.68 | Fair |
| Com. Ex. 4 | 4 | 5.0 | 0.0 | 400 or more | 96.7 | 0.74 | Poor |

Examples 1 to 4, in which both sound distortion and sound transmission loss were smaller, were rated as having "no crackling noise" (good). This means that the porous PTFE membranes of Examples 1 to 4 were effective in reducing sound transmission loss when sound passes through the membranes and, in addition, were more effective in reducing crackling noise than conventional porous PTFE membranes.

Figure 6:
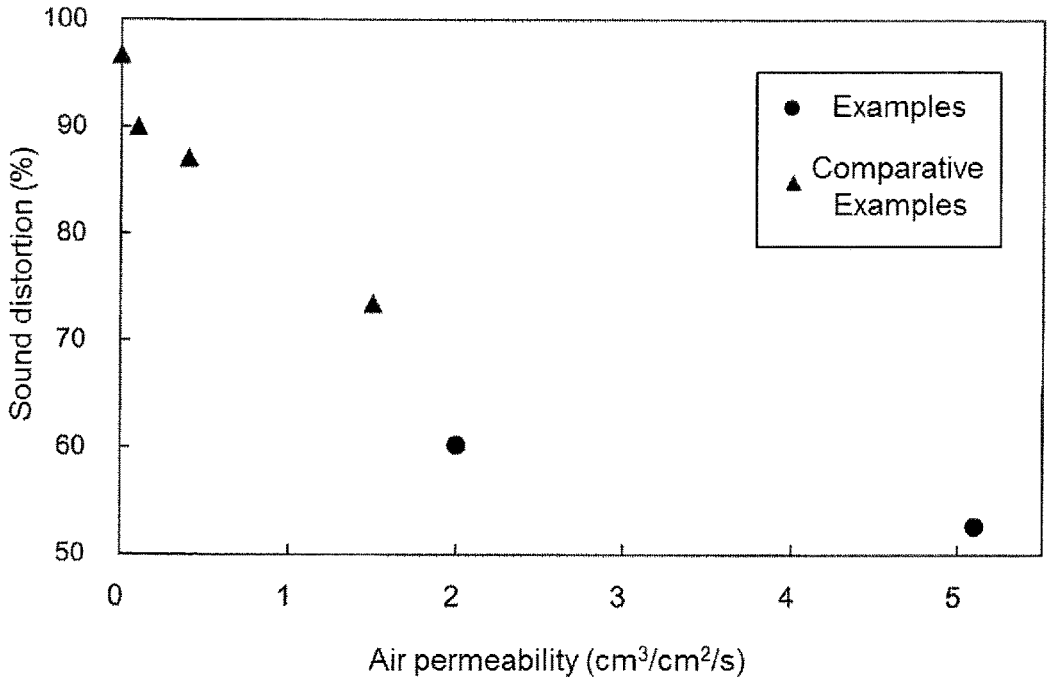
FIG. 6 is a graph showing relationship between air permeability and sound distortion in Examples and Comparative Examples.

According to the present inventors, the reason why sound distortion and sound transmission loss were both small in Examples 1 to 4 is presumably that the air permeability of the porous PTFE membranes were adjusted to as high as 2 $cm^3/cm^2/s$ or more. As shown in FIG. 6, the sound distortion rapidly decreases as the air permeability increases from 0 to 2 $cm^3/cm^2/s$ in terms of Frazier number. In contrast, the sound distortion slowly decreases as the air permeability increases from 2 $cm^3/cm^2/s$. This result confirms that it is desirable to adjust the air permeability to 2 $cm^3/cm^2/s$ or more to eliminate sound distortion due to vibration of the membranes.

In addition, the porous PTFE membranes of Examples 1 to 4 ensure waterproofness of at least IPX-4 level in terms of the degree of protection corresponding to waterproofness required for daily use. Therefore, the porous PTFE membranes of Examples 1 to 4 can provide sufficient waterproofness to electronic devices for use in real life environments. Thus, the porous PTFE membranes of Examples 1 to 4 are suitable for use in more acoustic characteristics-oriented electronic devices.

INDUSTRIAL APPLICABILITY

The waterproof sound-transmitting membrane of the present invention is suitable for use in electronic devices including audio equipment mounted therein. Specifically, the waterproof sound-transmitting membrane of the present invention is suitable for use in mobile phones, smartphones, digital video cameras, etc.

The invention claimed is:

1. A waterproof sound-transmitting membrane comprising a sound-transmitting region consisting of a single porous membrane of polytetrafluoroethylene, the porous membrane having a through-thickness air permeability of 2 $cm^3/cm^2/s$ or more as measured by Method A (Frazier method) for air permeability measurement according to Japanese Industrial Standards (JIS) L 1096 and a water entry pressure of 3 kPa or more as measured by Method B (high hydraulic pressure method) for waterproofness testing according to JIS L 1092, wherein the waterproof sound-transmitting membrane has a sound distortion of 60.2% or less, and wherein the porous membrane has a water entry pressure of 20 kPa or more and 50 kPa or less.

2. The waterproof sound-transmitting membrane according to claim 1, wherein the porous membrane has a through-thickness air permeability of 6 $cm^3/cm^2/s$ or less.

3. The waterproof sound-transmitting membrane according to claim 1, wherein the porous membrane has a through-thickness air permeability of 3 $cm^3/cm^2/s$ or more.

4. A waterproof sound-transmitting structure comprising:

a housing having an opening; and the waterproof sound-transmitting membrane according to claim 1 attached to the housing so as to cover the opening.

* * * * *